United States Patent [19]

Wolff et al.

[11] Patent Number: 4,561,828

[45] Date of Patent: Dec. 31, 1985

[54] PUMP FOR FORWARDING LIQUIDS

[75] Inventors: Horst Wolff; Franz Hani, both of Geretsried, Fed. Rep. of Germany

[73] Assignee: Speck-Kolbenpumpen-Fabrik Otto Speck KG, Geretsried, Fed. Rep. of Germany

[21] Appl. No.: 495,855

[22] Filed: May 18, 1983

[30] Foreign Application Priority Data

May 19, 1982 [DE] Fed. Rep. of Germany ..... 3218960

[51] Int. Cl.[4] ..... F04B 49/08; F04B 39/10; F04B 7/04; F16K 25/00

[52] U.S. Cl. ..... 417/307; 92/171; 251/83; 417/444; 417/489; 417/497; 417/539

[58] Field of Search ..... 417/497, 307, 539, 415, 417/445, DIG. 1, 311, 444, 489; 92/168, 171; 137/522; 251/83

[56] References Cited

U.S. PATENT DOCUMENTS

| | | | |
|---|---|---|---|
| 375,027 | 12/1887 | Vanduzen | 417/443 X |
| 2,846,140 | 8/1958 | Kemper | 417/539 X |
| 2,909,123 | 10/1959 | Jennings | 417/444 |
| 2,930,401 | 3/1960 | Cowan | 417/DIG. 1 |
| 3,548,721 | 12/1970 | Eisennegger | 92/168 X |
| 3,920,356 | 11/1975 | Bruggeman | 92/168 X |
| 4,050,860 | 9/1977 | Beres | 417/444 |
| 4,246,924 | 1/1981 | Droitsch et al. | 137/116 |
| 4,413,957 | 11/1983 | Sanders | 417/489 |

FOREIGN PATENT DOCUMENTS

| | | | |
|---|---|---|---|
| 879637 | 3/1943 | France | 417/489 |
| 294558 | 3/1932 | Italy | 417/497 |
| 530655 | 12/1940 | United Kingdom | 417/539 |
| 1174015 | 12/1969 | United Kingdom . | |

*Primary Examiner*—Carlton R. Croyle
*Assistant Examiner*—Theodore Olds
*Attorney, Agent, or Firm*—Townsend & Townsend

[57] ABSTRACT

A pump for forwarding liquids is described which has at least one pump chamber with inlet and outlet valves and also a plunger which periodically varies the volume of the pump chamber. To avoid the problems of dry running with very rapidly running pumps, and in order to overcome the resulting danger of destruction, the pump is arranged so that the closing force of at least one inlet valve of each pump chamber is controlled in dependence on the movement of the displacement member.

15 Claims, 3 Drawing Figures

PUMP FOR FORWARDING LIQUIDS

Figure 1:
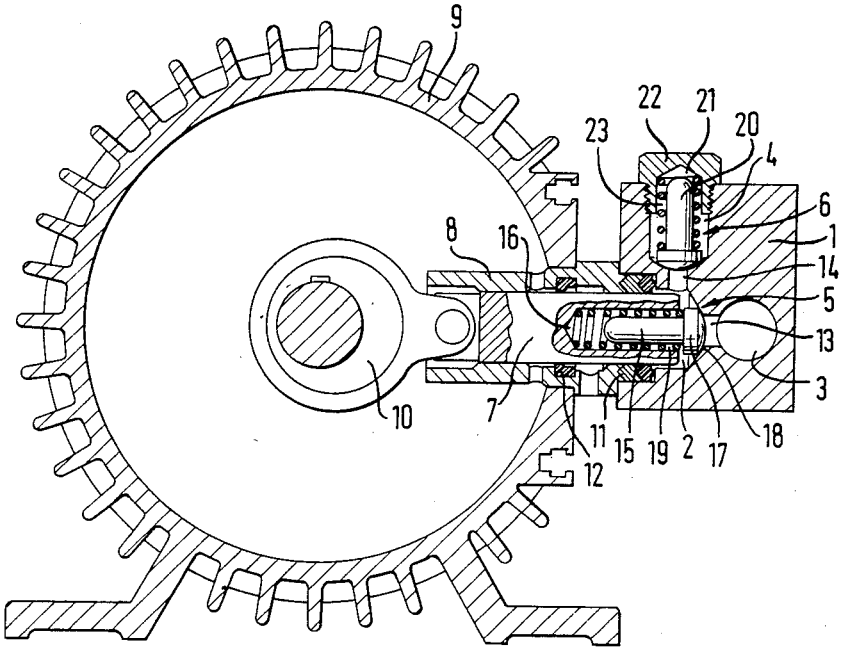

The invention relates to a pump, in particular a high pressure pump, for forwarding liquids, the pump comprising at least one pump chamber with inlet and outlet valves and at least one drivable displacement member for periodically varying the volume of the or each pump chamber.

A high pressure pump of this kind is known from U.S. Pat. No. 4,456,439. The scope of use of such high pressure pumps is very broad, they can for example be used for high pressure cleaners, for automatic car washes and for steam jet cleaners. Such pumps are also particularly suitable for forwarding water with additives such as are customary for the cleaning of vehicles and machine parts, and also for forwarding water with added pest control agents, insecticides and the like.

As a result of the performance required from such pumps previously known pumps have been comparatively complex and thus also expensive, which greatly hinders their use in small undertakings, and also on a large scale by private individuals and for hobbies. Attempts to achieve high performances, associated with an initial pressure of approximately 80 bars and above, by means of motors which can reach high speeds of rotation and which are good value for money have hitherto failed. This is because the suction phases are short at high speeds of rotation, for example 2000 revolutions per minute, and are not sufficient to suck the medium to be conveyed into the pump chambers. This is a consequence of the fact that the reduction in pressure which has to open the inlet valve of a pump chamber is too low or not present for a sufficiently long time in order to ensure the necessary opening of the spring biased inlet valve. The problem of dry running in the start up phase, which also frequently occurs with existing pumps is particularly serious with fast running pumps and can lead within a short period of time to destruction of the seals and thus to the pump becoming unusuable.

The principal object underlying the present invention is to develop a pump of the initially named kind so that even with low suction pressure and also temporally very short suction phases, i.e. very fast running pumps, a troublefree instantly effective sucking in of the medium to be conveyed is ensured while avoiding the problem of dry running in the starting up phase, and so that the high output pressure which is required is achieved with an extremely compact overall construction.

This object is satisfied in accordance with the invention in that the closing force of at least one inlet valve of each pump chamber is controlled in dependence on the movement of the displacement member.

The basic thought underlying the invention is thus that the bias force which presses the inlet valve against its seat should immediately be reduced by a significant amount at the start of each suction phase, so that the inlet valve can open and the pump chamber can begin to fill directly at the beginning of the suction stroke, even at very low pressure differentials. In this manner it is ensured that dry running effects are completely excluded, that even with fast running pumps troublefree and effective filling of the pump chambers occurs from the start of operation of the pump, despite the temporally short suction phases, and that the required high pump performances can be achieved even when using good value for money motors which have a high speed of rotation.

A particularly advantageous embodiment of the invention is characterised in that the displacement member consists of a piston or plunger which is driven to and fro and moves within the pump chamber; in that the inlet valve is arranged coaxial to the piston or plunger, with the valve poppet which moves relative to the valve seat being guided within a blind bore of the piston or plunger, said blind bore opening at an end face of said piston or plunger; and in that a compression spring supported within the blind bore exerts a biasing force on the valve poppet which changes in dependence on the displacement of the piston or plunger.

By integrating a part of the inlet valve, i.e. of the movable valve poppet, into the piston or plunger one obtains a space and weight saving which is very significant in practice, and also a very desirable reduction of the dead space.

The respective outlet valves preferably each likewise comprise a valve poppet which cooperates with a valve seat and is subjected to spring bias, with the valve poppets being constructed in the same manner as a valve poppet which is guided in the piston or plunger. This measure results in technical manufacturing advantages.

A particularly space saving arrangement which is favourable to manufacture is obtained, in accordance with the invention, in that several pump chambers are provided adjacent one another in one plane in a housing block, in that a suction chamber common to all pump chambers consists of a bore which is disposed in the plane of the pump chambers and extends transverse to the axes of the pump chambers; and in that the pump chamber end of a short connecting bore between each pump chamber and the suction chamber is constructed as a valve seat for the valve poppet, which is displaceably guided in the piston or plunger associated with the respective pump chamber.

It is evident that by omitting customary inlet valves and by extensive integration of the inlet valves of the invention into the pistons or plungers, the suction chamber, which preferably consists of a bore, can be placed in the direct vicinity of the pump chambers, which results in a considerable material and weight saving in the practical form of the pump housing block.

It is of great advantage with all embodiments of the invention that the movable valve part of the inlet valve only lifts from its seat by a small amount so that in operation only low impact speeds occur which in turn lead to reduced noise and reduced wear. Moreover, it is of important significance that in the pump phase the closing force on the inlet valve, and thus also the increase in pressure in the pump chamber, increases with the corresponding movement of the piston or plunger. This leads to a very rapid and reliable closing of the inlet valve and prevents water from being forced out into the suction chamber. The degree of efficiency of the pump is thus increased in the desired manner.

Finally, a further development of the invention which is attractive in its compactness is characterised in that a throughgoing stepped bore which serves to accommodate a relief valve is provided in the region of one end of the housing block; and in that this relief valve has a piston which is loaded by the pressure prevailing in the pressure chamber against the bias force and which is provided with an actuating stem, with the actuating stem controlling a valve element in a by-pass path, the valve element contacting a valve seat under spring pressure and consisting of a ball.

It is particularly advantageous that the connections required to integrate the relief valve into the block of the housing do not lead to a disturbing degree of complexity during manufacture because the flow paths that are required can be provided by extension of already existing passages or by intersecting passages.

Figure 2:
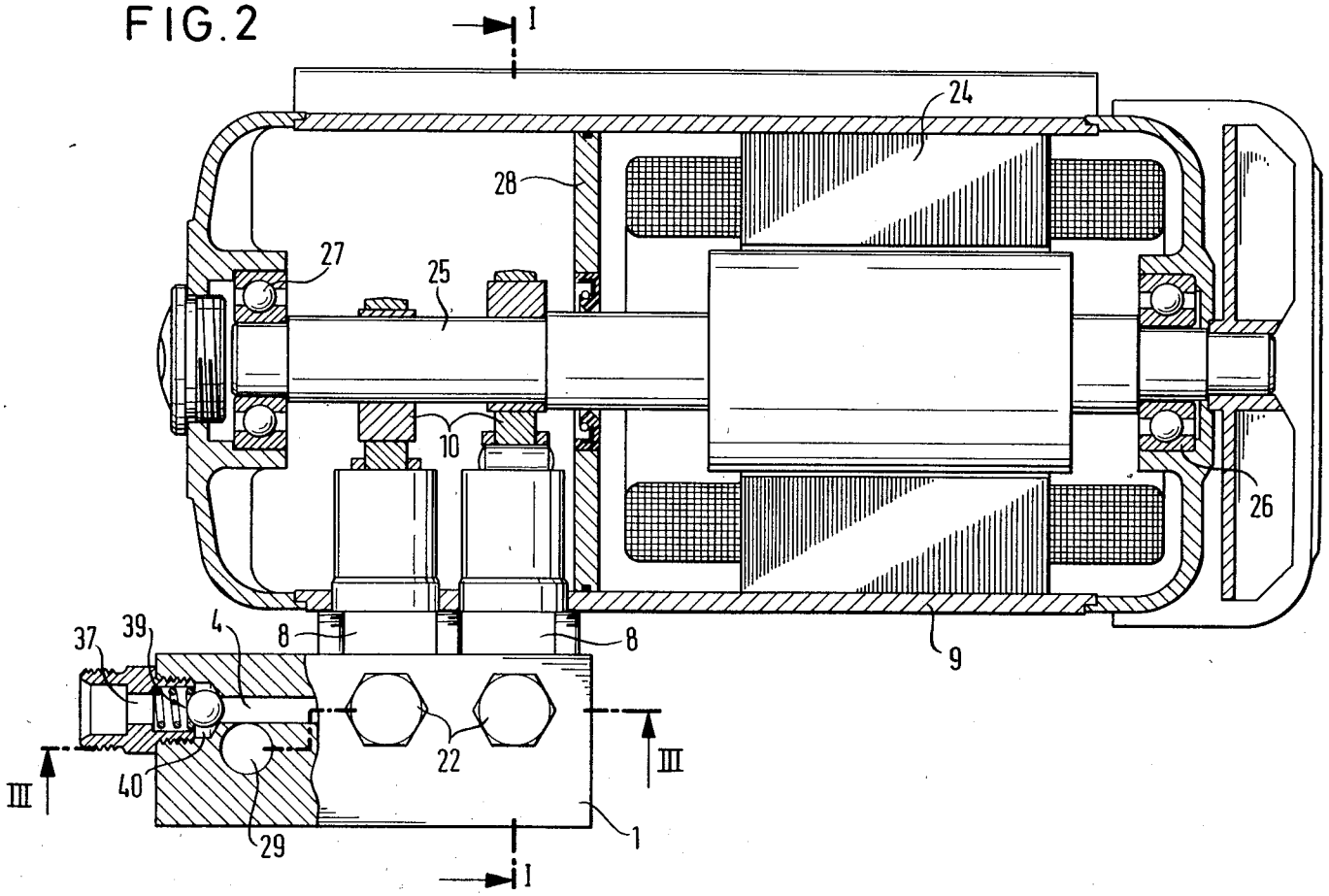
Figure 3:
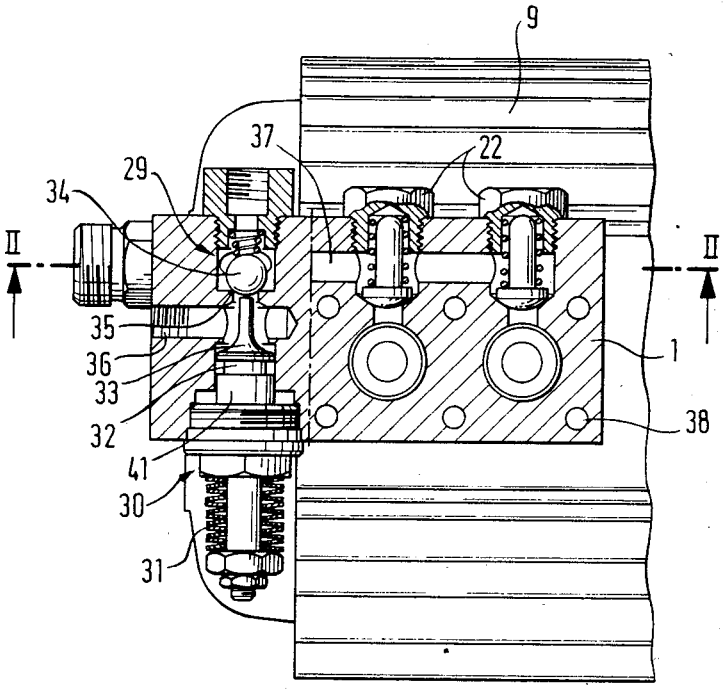

The invention will now be described in more detail and by way of example only with reference to an embodiment as illustrated in the drawings which show:

FIG. 1 a schematic partly sectioned illustration of a pump associated with an electric drive motor in accordance with the invention, FIG. 2 a likewise schematic and partially sectioned plan view of the arrangement of FIG. 1, and FIG. 3 a partial side view of the arrangement of FIG. 1 with the pump being sectioned and being shown with an integrated relief valve.

As seen in FIG. 1 pump chambers 2, a suction chamber 3 and a pressure chamber 4 are provided in a compact rectangular housing block 1.

The suction chamber 3 and the pressure chamber 4 consist of parallel bores which are displaced relative to one another, related to the axes of the pump chambers, by 90° Each of the bores opens at an end face of the housing block 1.

The pump chambers 2 arranged alongside one another in one plane likewise consist of short bores of stepped construction, with the innermost part of each bore having the smaller diameter forming the actual pump chamber and with the outermost part of each bore having the larger diameter serving to accommodate the respective guide sleeve 8 for the plunger 7 and/or to accommodate a high pressure seal 11.

An inlet valve 5 and an outlet valve 6 are associated with each pump chamber 2.

The plunger 7 which moves in the pump chamber 2 is driven to and fro via a motor and an eccentric drive 10. In the customary manner a low pressure seal 12, which simultaneously forms the transmission seal, is provided in the guide sleeve 8 which accommodates the plunger 7. The guide sleeve 8 extends into the motor housing 9 and simultaneously serves as a spacer element between the housing block 1 and the motor housing 9. The mutual fixation of the motor housing 9 and the housing block 1 takes place via several threaded bolts (set screws) the arrangement of which can be seen in FIG. 3.

A short connection bore extends between the suction chamber and each pump chamber with the connection bore being axially aligned with the pump chamber 2 and the plunger 7. The pump chamber end of this connection bore forms a valve seat 18 for the head part 17 of a valve poppet 15 which is axially displaceably received in a central blind bore 16 of the plunger 7. The valve seat 18 is normally of conical construction whereas the head part 17 which cooperates therewith has a part-spherical surface.

The valve poppet 15 provided with the head part 17 is biased by means of a compression spring 19 in the direction of the valve seat 18. This compression spring 19 is located in the annular chamber between the poppet 15 and the wall of the blind bore 16, and is braced at one end in the blind bore 16 and at the other end against the annular shoulder which forms the transition between the poppet 15 and the head part 17.

The compression spring 19 and the valve poppet 15 are loosely guided in the blind bore 16 which means that no form of tight tolerances need to be observed during manufacture. Despite this loose guidance of the movable part of the inlet valve the inlet valve fulfils its function in an ideal manner.

The bias of the compression spring 19 is preferably selected so that at top dead centre, i.e. the position illustrated in the drawing, the bias on the movable valve element 15, 17 corresponds to that usual with customary inlet valves. This dimensional statement is however merely by way of example.

Each pump chamber 2 is furthermore connected with the outlet valve 6 which is located between the pump chamber 2 and the pressure chamber 4 via a short connection bore 14. Each outlet valve 6 consists of a valve poppet 20 which is spring-biased by compression spring 23 and which cooperates with a valve seat. The valve poppet 20 is preferably constructed in the same manner as the valve poppet 15, 17 guided in the plunger 7 and, in accordance with a preferred embodiment, consists of synthetic material. The valve poppets 20 of the outlet valves 6 are arranged in individual bores which pass centrally through the pressure chamber 4 and are guided in recesses 21 in threaded plugs 22 which sealingly close these individual bores.

The pump arrangement of FIG. 1 operates as follows:

At top dead centre, i.e. the position shown in the drawing, the movement of the plunger 7 reverses with the outer valve 6 and the inlet valve 5 being closed. The contact pressure at the valve seat 18 exerted by the plunger on the valve poppet 15, 17 via the spring 19 is largest in this position.

If the plunger 7 now moves away from the top dead centre position towards bottom dead centre, as a result of rotational movement of the eccentric drive 10, then a relative displacement occurs at the start of this movement between the plunger 7 and the valve poppet 15, 17 which simultaneously and necessarily results in a reduction of the bias force of the spring 19 acting on the valve poppet. This immediately effective reduction of the bias force has, in conjunction with the simultaneously arising pressure differential originating from the increase in size of the pump chamber 2, the result that the head part 17 lifts from the valve seat 18 and that the medium to be conveyed, in particular water, enters into the pump chamber 2 from the suction chamber 3. It is important that the time at which water enters into the pump chamber, i.e. the time at which the pump chamber begins to fill coincides almost directly with the start of the suction stroke of the plunger 7, which is made possible by the joint effect of the reduction of the bias force and the start of the reduction in pressure in the pump chamber 2. As a result of the exclusion of any deleterious delay between the time at which the suction stroke starts and the time at which the pump chamber starts to fill it is ensured that, on the one hand, no dry running problems occur and that, on the other hand, problemfree induction, and thus pumping, is ensured even with very short suction phases which are caused by a high speed of rotation of the plunger drive motor.

In the further course of the suction stroke, during the movement of the plunger 7 towards bottom dead centre, the poppet 15 emerges partly out of the blind bore 16 because the head part 17 only lifts from the valve seat 18 by a small amount, for example 1 to 2 mm, however trouble-free filling of the pump chamber is nevertheless obtained.

When the plunger 7 leaves bottom dead centre, which corresponds to the maximum volume of the pump chamber 2, then the bias on the valve poppet 15, 17, which had its minimum value at the bottom dead centre position of the plunger 7, immediately increases which leads to a very rapid and reliable closing of the inlet valve 5. This rapid closing of the inlet valve during the pump stroke has very advantageous effects on the efficiency of the pump. It should also be noted that the water which enters into the blind bore 16 is in no way lost from the pump action because the free volume of the blind bore forms a part of the pump chamber.

As the pressure increases in the pump chamber 2 the outlet valve 6 finally opens whereupon the water in the pump chamber 2 is transmitted into the pressure chamber 4 at high pressure. The minimal dead space achieved by the construction of the invention is very advantageous in this respect.

When the plunger 7 has reached top dead center the described process starts once again. The suction and expulsion processes during the suction and compression strokes explained above with reference to one pump chamber take place in the same manner in the further pump chambers that are provided. It is evident that the indicated principle can be realised without difficulty when using multi-plunger pumps and also when using a boxer arrangement of the pump chambers.

FIG. 2 shows an electric drive motor 24. The pump explained in relation to FIG. 1, or the housing block 1 of this pump, is connected directly with the housing 9 of the electric drive motor. The housing 9 consists preferably of a continuous cast part, which gives rise to the possibility of simply and economically realising various housing lengths in dependence on the number of plungers provided in any particular case.

Having regard to the desired simplification of the overall construction of the drive motor and pump, and also having regard to the desire of a compact overall construction, it is important that in the illustrated arrangement the eccentric drives 10 for the plungers are directly attached to the motor shaft 25, which is extended for this purpose. The two motor bearings 26, 27 effectively satisfy a double function in this embodiment, because they are used on the one hand to support the motor and on the other hand to support the plunger drive shaft, which would otherwise require separate bearings.

A partition wall 28 is expediently provided between the region which accommodates the eccentric drives 10 and the rotor region and the oil-filled eccentric chamber of the motor can be sealed off by means of this partition wall.

The broken away region of the pump housing block 1 makes it possible to see that the pressure chamber bore 4 can be provided with a non-return valve 39 in the region of its end face opening. The pressure chamber bore 4 is also intersected by a bore 29 which passes through the housing block 1 and which has different diameters along its length. The bore 29 serves to accommodate a relieve valve 30 shown in FIG. 3. A bore 40 having a comparatively small diameter can also be seen. The bore 40 opens into the main flow path behind the non-return valve 39 as seen in the direction of flow and extends through the housing block 1 to a chamber for the relief valve which is to be inserted into the bore 29, which is restricted at one side by a displaceable piston. Instead of directly attaching the eccentric drives 10 to the shaft of the motor 24, which is an electric motor (but could also be an internal combustion engine), it is possible to construct that part of the total arrangement which extends up to the partition wall 28 as a unit, which can then be directly flanged onto a drive motor, which does not have to have an extended shaft.

FIG. 3 shows a sectional view of the housing block 1 with integrated relief valve 30. It should be mentioned at this point that the integration of a relief valve into the housing block is particularly advantageous because the necessary flow connections can be particularly simply realized by extending existing bores and providing intersecting bores. However the housing block 1 with the pump chambers, suction and pressure and also inlet and outlet valves can also be constructed without an integrated relief valve. The view of FIG. 3 also shows the position and arrangement of bores 38 in the housing block 1 by means of which this housing block 1 can be reliably and permanently connected with the motor housing 9 via threaded bolts.

The basic principle of the relief valve integrated into the housing block 1 is described in detail in U.S. Pat. No. 4,246,924.

The relief valve 30, consists of a bias unit 31 in the form of a pack of plate springs, a piston unit 32 with an attached actuating stem 33 and a valve unit defined by a valve seat 35 and a ball 34 which contacts the valve seat 35 under spring bias. The relief valve is inserted into the main flow path 37 and opens a by-pass path which can be connected with the inlet side of the pump at a relief pressure which can be predetermined via the bias unit 31. The bore 36 which belongs to the by-pass path is preferably closed at its outer end and extended into the housing block 1 so that it forms a direct connection with the suction chamber. In this case one obtains a closed internal circuit once the relief valve responds.

The opening of the by-pass flow path 36 takes place when the actuating stem 33 lifts the ball 34 from the valve seat 35 against the force of the bias spring that is provided. This occurs when the pressure in the chamber 41 which is restricted at one side by the piston 32 rises in such a way that the retaining force exerted by the bias unit 31 is exceeded. The pressure in the chamber 41 corresponds in each case to the pressure in the main flow path after the non-return valve 39 because—as mentioned in connection with FIG. 2—this main flow path 37 is connected with the chamber 41 via the bore 40.

It is evident that the flow path required for the relief valve can be realized with very little effort by exploiting the bores already present in the housing block 1, through extension of such bores and by means of simple additional bores which intersect the existing bores. This result in a pump arrangement with an integrated relief valve. The pump arrangement is extremely compact, has a low weight and thus allows considerable material savings.

As a result of the extremely compact construction of the pump arrangement in accordance with the invention, which nevertheless is very reliable and permits high performance, it is possible to manufacture motor pump aggregates using fast running and thus inexpensive but nevertheless powerful drive motors in a particularly economic manner. This then considerably enlarges the range of applications of such aggregates when compared with previously known arrangements.

We claim:

1. A high pressure pump for liquids comprising:

a housing defining a pump chamber;

inlet and outlet valves fluidly coupled to the pump chamber;

a drivable displacement member, including a plunger movable to and fro within the pump chamber, for periodically varying the volume of the pump chamber; and the inlet valve being arranged coaxially to the plunger and including:

a valve seat in the housing;

a movable valve poppet which moves relative to the valve seat, the valve poppet being guided within a blind bore formed in the plunger, said blind bore opening at an end face of said plunger; and a compression spring supported within the blind bore for exerting a biasing force on the valve poppet which changes in dependence on the displacement of the plunger so to vary the closing force on the inlet valve in dependence on the movement of the plunger.

2. A pump in accordance with claim 1 wherein the valve poppet includes a cylindrical guide part which engages in the blind bore and a head part which cooperates with the valve seat, the diameter of the head part being larger than the diameter of the guide part, and wherein the compression spring is braced against an annular shoulder formed at a transition between the guide part and the head part.

3. A pump in accordance with claim 2 wherein the valve seat in conical and the region of the head part which cooperates therewith is of spherical shape.

4. A pump in accordance with claim 1 wherein the outlet valve comprises a spring biased outlet valve poppet which cooperates with an outlet valve seat.

5. A pump in accordance with claim 4 wherein the valve poppet and the outlet valve poppet are made of synthetic material.

6. A pump in accordance with claim 4 wherein the outlet valve and the inlet valve are oriented at about 90 degrees to one another.

7. A pump in accordance with claim 1 including:

several pump chambers provided adjacent one another in one place in the housing;

a suction chamber common to all pump chambers comprising a bore in the one plane of the pump chambers and extending transverse to the axes of the pump chambers; and a pump chamber end comprising a short connecting bore defined between each pump chamber and the suction chamber, the pump chamber ends each forming a valve seat for a valve poppet, each valve poppet being displaceably guided in a bore in the associated displacement member.

8. A pump in accordance with claim 7 further including:

a pressure chamber defined within the housing and comprising a bore parallel to the suction chamber;

an outlet valve bore passing through the pressure chamber to each pump chamber; and a screw threaded plug closing each outlet valve bore in a pressure tight manner, each plug having a plug recess forming an extension of the associated outlet valve bore; and wherein:

each outlet valve is arranged in the associated outlet valve bore and comprises a spring biased valve poppet movably guided in the associated plug recess.

9. A pump in accordance with claim 1 further comprising:

a pump drive operably coupled to the displacement member to reciprocate the displacement member within the pump chamber;

a guide sleeve and adapted to space apart and fix the housing and the pump drive to one another;

a low pressure seal sealingly engaging the reciprocating displacement member to the guide sleeve; and a high pressure seal sealingly engaging the guide sleeve, the reciprocating displacement member, and the pump chamber.

10. A pump in accordance with claim 9 wherein:

the pump drive includes a drive housing, a drive shaft, and an eccentric drive mounted on the drive shaft;

the guide sleeve is mounted to the drive housing; and the displacement member is operably coupled to the eccentric drive.

11. A pump in accordance with claim 10 wherein the pump drive includes a rotor mounted to the drive shaft and a motor bearing mounted to the motor housing and supporting the drive shaft, the eccentric drive being attached to the drive shaft between the rotor and the motor bearing.

12. A pump in accordance with claim 8 further including:

a bypass bore in the housing parallel to the pressure chamber and in flow communication with the suction chamber;

a through going stepped bore at one end of the housing passing through the bypass bore and opening into the pressure chamber;

a biased relief valve accommodated in the stepped bore and comprising an adjustable actuating stem, a relief valve seat, and a spherical valve element biased against the relief valve seat and displaceable to permit liquid in the pressure chamber to flow through the stepped bore and the bypass bore to the suction chamber, the displacement of the valve element being actuable by the actuating stem.

13. A pump in accordance with claim 12 further including a linear main flow path comprising a pump outlet and the pressure chamber.

14. A pump in accordance with claim 11 wherein the drive shaft has first and second outer ends and wherein motor bearings support the first and second drive shaft outer ends only.

15. A pump in accordance with claim 1 wherein the pump chamber includes a pump cylinder bore in the housing and further comprising a drive motor including a cylindrical drive housing, the length of which being selected in dependence on the number of displacement members used, the drive motor including a drive shaft to which the displacement member is coupled.

* * * * *